US005976008A

United States Patent [19]

Rubin

[11] Patent Number: 5,976,008

[45] Date of Patent: Nov. 2, 1999

[54] ELEVATOR ASSEMBLY FOR USE WITH SMOKE REDUCTION APPARATUS

[76] Inventor: Benjamin Rubin, 104-60 Queens Blvd., Forest Hills, N.Y. 11375

[21] Appl. No.: 09/093,669

[22] Filed: Jun. 8, 1998

Related U.S. Application Data

[62] Division of application No. 08/898,297, Jul. 22, 1997.

[51] Int. Cl.[6] ..... B08B 15/02

[52] U.S. Cl. ..... 454/63

[58] Field of Search ..... 454/63, 56, 65, 454/341, 230, 66

[56] References Cited

U.S. PATENT DOCUMENTS 4,926,293 5/1990 Saba ..... 362/96

5,063,834 11/1991 Aalto et al. ..... 98/115.1

5,562,286 10/1996 Brinket ..... 273/309

FOREIGN PATENT DOCUMENTS 6-58582 3/1994 Japan ..... 454/63

*Primary Examiner*—Harold Joyce
*Assistant Examiner*—Derek S. Boles
*Attorney, Agent, or Firm*—Bauer & Schaffer, LLP

[57] ABSTRACT

An elevator assembly for use with a second hand smoke reduction device having a chimney assembly for capturing and exhausting smoke away from a smoker, the elevator assembly having a plurality of telescopically arranged support tubes for supporting the chimney assembly, the support tubes being configured so that the chimney assembly can be vertically adjusted allowing the smoker to position the chimney adjacent his/her mouth to capture expelled smoke.

20 Claims, 5 Drawing Sheets

Fig. 5C
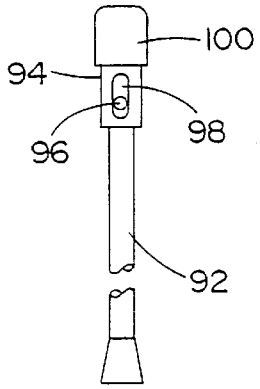
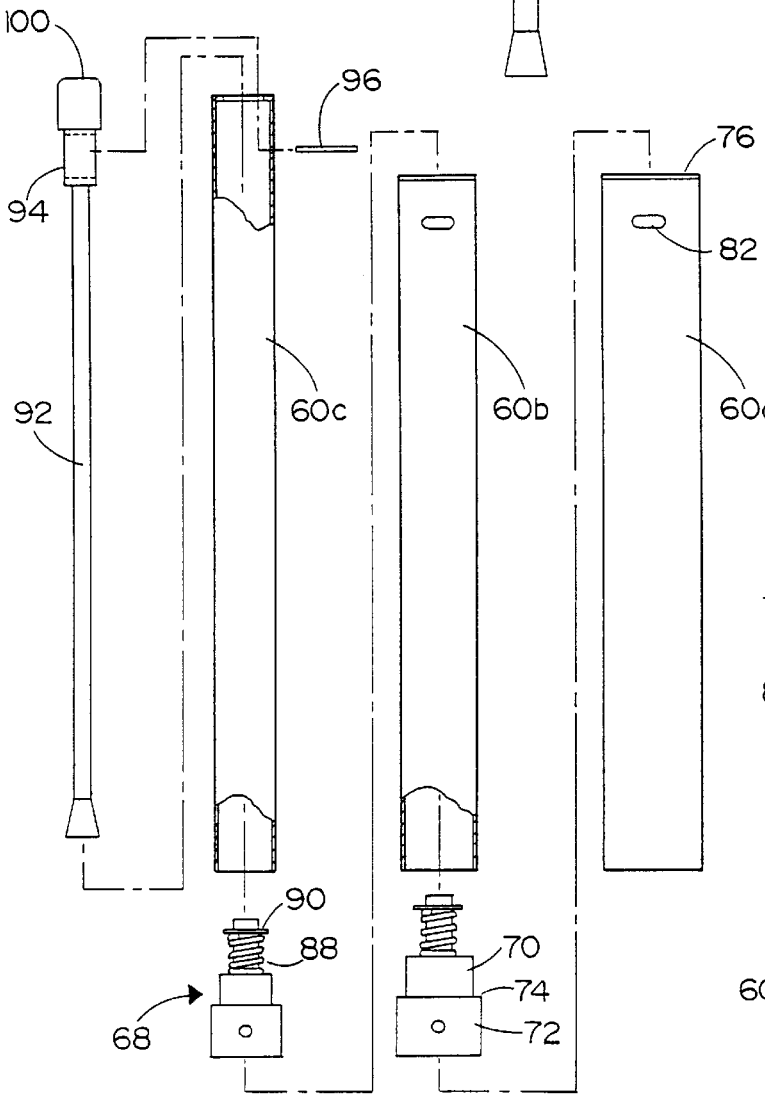
Fig. 5A
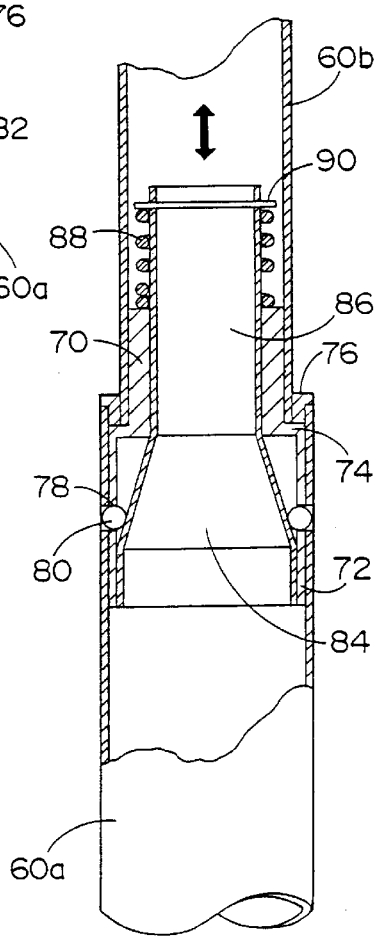
Fig. 5B

ELEVATOR ASSEMBLY FOR USE WITH SMOKE REDUCTION APPARATUS

RELATED APPLICATION

This application is a divisional of a copending application, Ser. No. 08/898,297 filed on Jul. 22, 1997 entitled Apparatus for the Reduction of Tobacco Smoke for which benefit under 37 USC 120 is claimed.

BACKGROUND OF THE INVENTION

The present invention relates to an apparatus for the reduction of tobacco smoke produced in a closed environment, and in particular, to apparatus for the removal of "second hand smoke" from gambling tables at casinos.

The conventional manner of dealing with the problem of second hand smoke has been to enjoin the use of tobacco in its entirety. However, since smoking in casinos is an inherent part of the gambling milieu, prohibiting smoking in its entirety can result in loss of patronage and damage to the establishment. Another attempted solution has been to provide increasingly stronger apparatus' for ventilizing such rooms. Such equipment is not only larger, but is more costly and complex both in installation and in use.

It has been found that the conventional apparatus, normally placed within the ceiling of the casino, is only partially effective in removing all the smoke. Such equipment removes air, and, therefore, whatever smoke found in it is from the upper level of the room. It is significantly less effective in capturing and removing the smoke and especially the particulates in the smoke from the lower half of the room, particularly smoke produced and found on the level of the patrons producing such smoke. It is the smoke in this space which is most detrimental to smokers and non-smokers as "second hand smoke".

In a prior application, Ser. No. 08/898,298, entitled APPARATUS FOR REMOVAL OF SECOND HAND SMOKE, I have disclosed apparatus for the removal of smoke from congested areas, particularly from the slot machine area of casinos. The apparatus disclosed in the copending application is placed between adjacent slot machines and is operable without interference with the convenient play of the casino client.

Such apparatus is not usable for installation at or in other casino areas, as for example, at a poker table or baccarat table where its placement on top of the playing table would, in fact, be a severe impediment to play.

It is an object of the present invention to provide an apparatus which acts to capture the smoke as it is generated by the smoker while seated at a gaming table and transmits the smoke to the upper levels of the room to be handled by the ventilating equipment.

It is another object of the present invention to provide casinos and similar establishments with equipment to remove smoke immediately upon its creation from relatively confined rooms or areas such as poker rooms and baccarat pits.

These objects together with other objects and advantages are set forth in the following disclosure:

SUMMARY OF THE INVENTION

According to the present invention, the apparatus comprises a smoke removal chimney assembly for receiving smoke. The chimney assembly is mounted in a box like container, open at its top, and slidably supported to hang from the undersurface of the table adjacent the seat or table at which the patron sits. The container is slidable out from beneath the table to a position adjacent the seat whereupon the patron may raise the chimney assembly to a position adjacent the patron's face. The chimney assembly comprises a duct-like cylinder provided with an opening into which the patron expels the smoke. The cylinder is elongated, rising to a height above the head of the user when sitting at the gaming table. At the upper end of the duct, there is provided a fan which sucks the smoke up and then propels it to an upper level beyond the 5 ft. rise, toward the ventilating system before being recirculated.

The chimney assembly is mounted within the box container to be supported in balance by a pair of platforms movable by one or more telescoping supports and one or more spring loaded cables so that when lifted, the assembly is stable and balanced, obviating any care or concern on the part of the patron, except to use the same.

Full details of the present invention are set forth in the accompanying drawings and the following description.

BRIEF DESCRIPTION OF THE DRAWINGS

In the Drawings

FIGS. 5A, 5B and 5*c* are enlarged views, partially sectioned showing the details of the telescoping supports.

DESCRIPTION OF THE INVENTION

Figure 1:
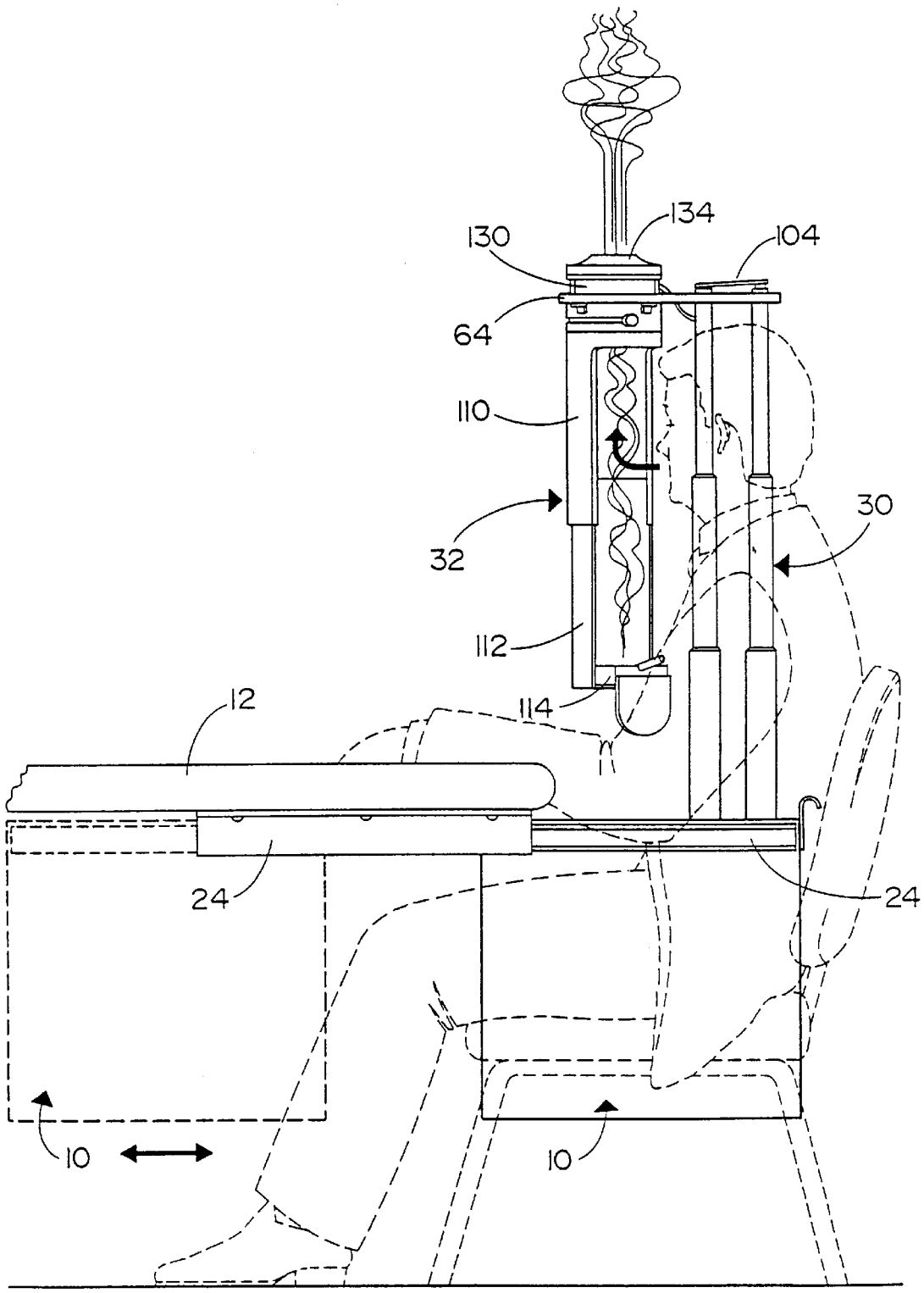
FIG. 1 is a side elevational view showing a player seated at a casino table to which is attached the housing in which is contained the smoke removal device of the present invention.

As seen in FIG. 1, the smoke removal apparatus, contained in a box like housing generally depicted by the numeral 10, is illustrated as depending from the lower surface of a casino poker table 12. It will be appreciated, however, that the invention may be applied to other tables not only within the casino, but elsewhere, such as bingo halls where people congregate for long periods.

Figure 2:
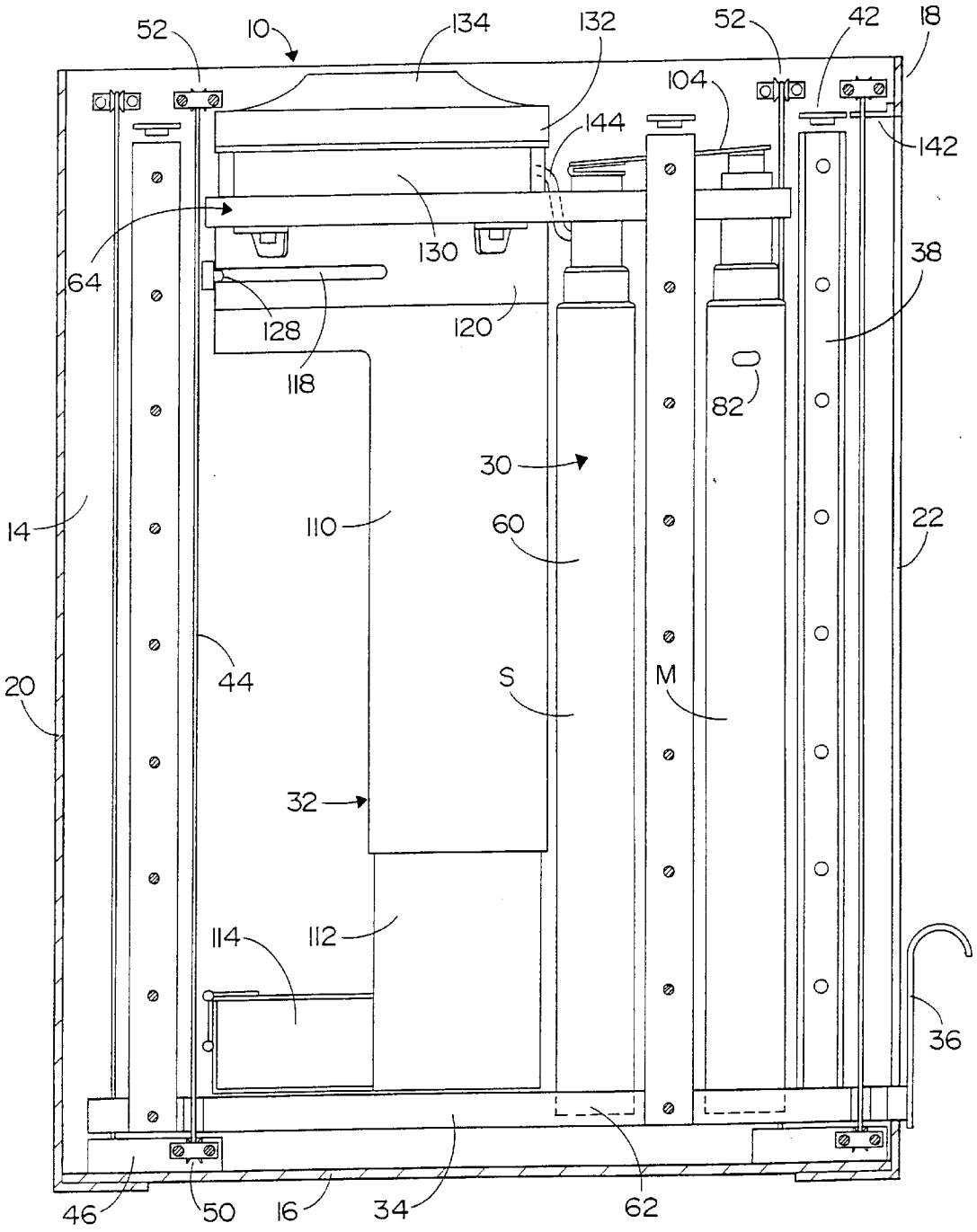
FIG. 2 is a side elevational view showing the apparatus of the present invention nested in its housing, the front panel of the housing being removed.
Figure 3:
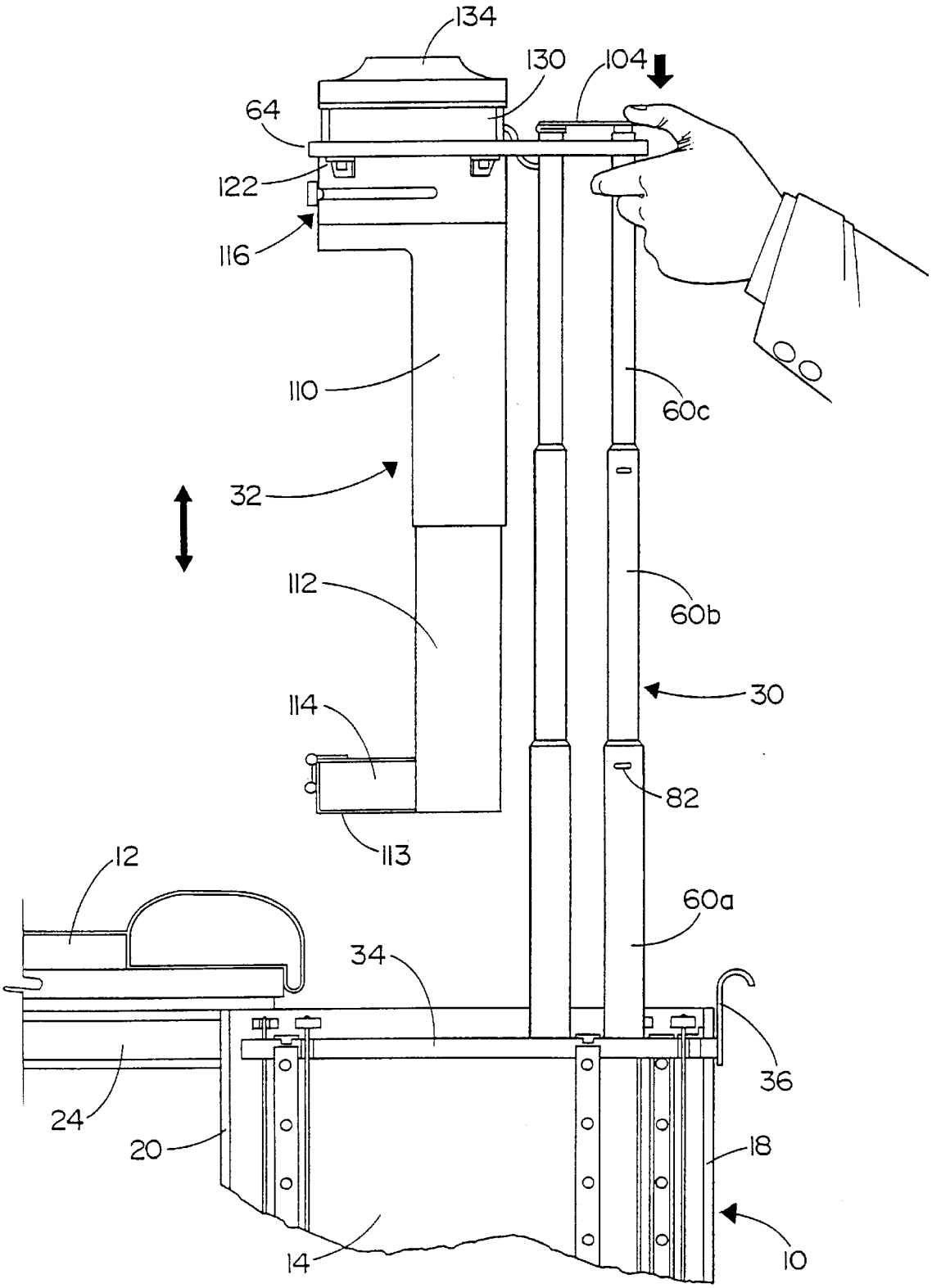
FIG. 3 is a view similar to FIG. 2 showing the chimney apparatus extending upward from the housing.
Figure 4:
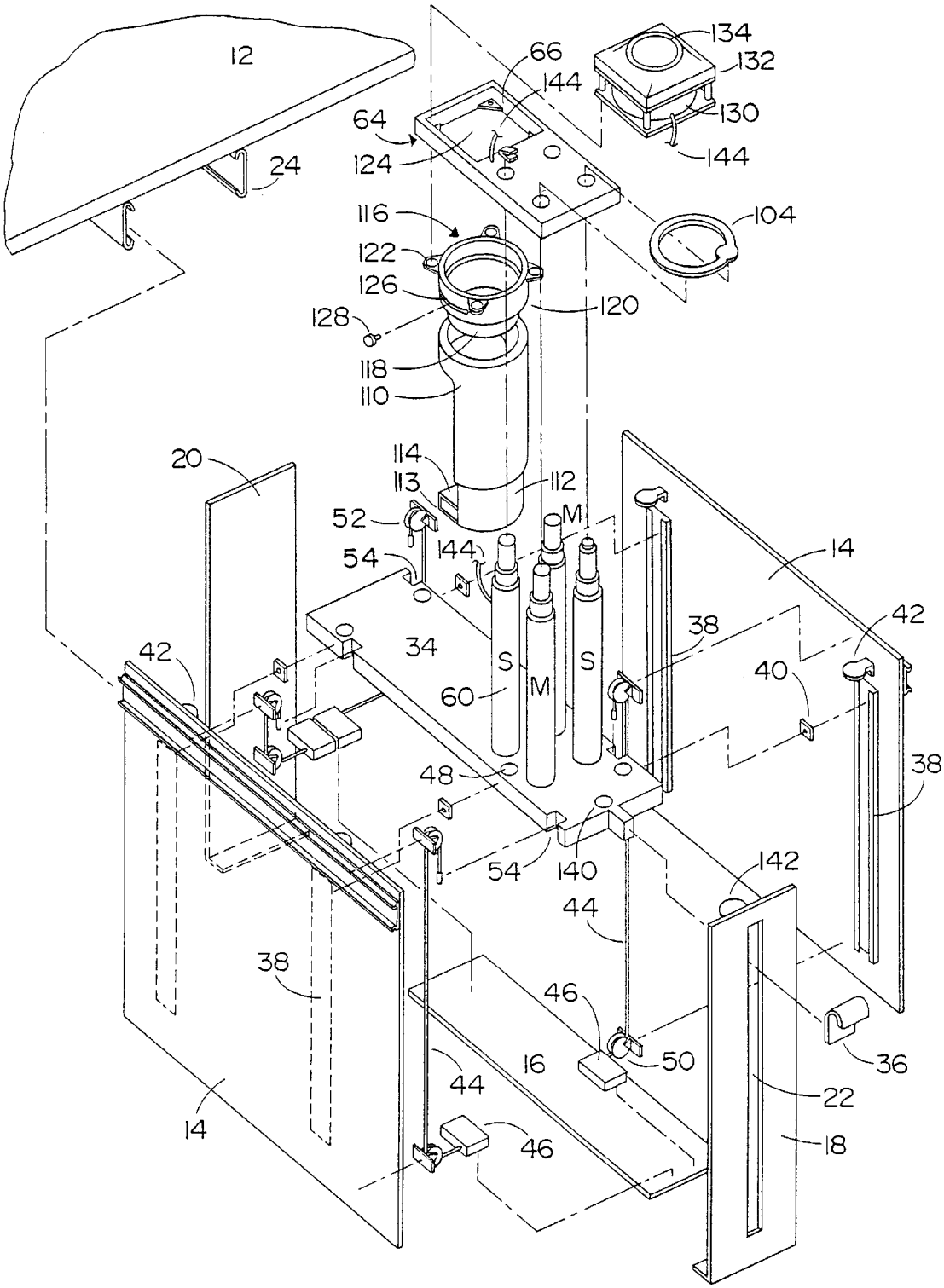
FIG. 4 is an enlarged exploded view of the apparatus of the present invention showing the details thereof.

As seen in FIGS. 2–4, the housing 10 is provided with a pair of rectilinear side walls 14, a bottom wall 16, a front wall 18 and a rear wall 20. The front wall 18 is provided with an elongated slot 22, the purpose of which is to be described later. The housing is open at its top.

The housing 10 is hung from the lower surface of the table 12 by a pair of slide mechanism 24 each having one part secured to the table and another to the exterior surface of the side walls 14 adjacent the upper edge of the housing. In this manner, the housing 10 may be stowed beneath the table (dotted lines, FIG. 1) when the apparatus is not in use and pulled forwardly adjacent the patron when used, as seen in full lines in FIG. 1.

Located within the housing 10 is an elevator and support assembly, generally depicted by the numeral 30, and which carries the smoke removal chimney assembly, generally depicted by the numeral 32.

The elevator and support assembly 30 comprises a metal bottom platform 34 having a length and width almost equal to the bottom wall 16, but sufficiently free of contact with the side and end walls 14, 18 and 20 to allow the platform 34 to move freely upwardly and downwardly. The lower platform 34 is provided with a handle 36 protruding through the elongated slot 22 to permit manipulation of the platform. If desired, this handle may be used as well to pull the housing out from beneath the table. The bottom platform may be made of a ferrous metal, or it may be made of aluminum or plastic.

To insure that the platform 34 remains horizontal and that it is prevented from canting during its movement, each of the side walls 14 is provided with a pair of linear trackways 38, one adjacent the rear wall 20 and one adjacent the front wall 20. The trackways 38, on one wall, are in opposition to those on the other wall. The trackways 38 are U-shaped channel members opening inwardly of the housing. Attached to the side edges of the platforms 34, in registry with each of the trackways 38, is a bracket 40 which slidably fits into the opening in the U-shaped trackway. The trackways 38 and the brackets 40 are made from suitable low friction materials or combinations so that lifting of the platform is unhindered.

Mounted at the top of each of the trackways 38 is a stop member 42, the purpose of which is to limit the upward movement of the platform 34. Preferably, the lower platform is provided with magnet discs 48 aligned with the stop member 42 so that when the platform is raised, the platform can be held in place. On the other hand, should the platform be made of a ferrous metal, then the stop member 42 must have the magnets attached to them. Thus, the stop members 42 will hold the lower platform firmly in its upper position.

To reduce the weight of the platform 34 and the mechanisms carried on the platform, a pair of constant force cables 44 are spaced on each side of the platform 34. Each constant force cable 44 is attached at one end to a spring device housed in a small container 46 secured to the bottom wall 16 of the housing 10, and its other end entrained over a lower pully 50, an upper pully 52 and terminally secured to the platform 34. The edge of the platform 34 is notched at 54 to provide for free movement of the cable 44 and for room to anchor the free end. As seen in the drawings, the cables 44 on one side of the platform need not be directly opposed to those on the other side since the cables are employed to overcome weight and not to stabilize or orientate the platform and its load.

Mounted on the platform is a quadrilateral array of four elevator supporting posts 60. Each post 60 comprise a set of decreasing diameter tubes set one within the other in slidable telescoping manner. The lower most or largest tube is set within a recess 62 formed in platform 34 and firmly secured by welding, screws, bolts, or the like so as to be extendible in a vertically fixed position. Mounted on the upper end of the uppermost post 60, (i.e., to each of the smaller tubes) is a second platform 64 which is smaller in length and width than the lower platform 34. Preferably, the platform and tubes are joined by set screws to be easily dismountable. If a more permanent mounting is desired, this upper or second platform 64 is firmly fixed to the tubes 60 as by welding or the like. In any event, the platform extends cantilevered toward the rear wall 20 and parallel to the side walls 14 so that a platform extension 66 extends laterally over the lower platform 34.

As seen in FIGS. 5A, 5B and 5*c,* each post 60 comprises three slidingly telescoping tubes 60*c,* 60*b* and 60*c*. A pair of hollow junction or fitting 68 is provided to connect the smallest and the intermediate tubes 60*a* and 60*b* and the intermediate and largest tubes 60*b* and 60*a,* respectively. Each fitting 68 comprises a stepped cylindrical member having an upper portion 70 and a lower portion 72 offset to provide a shoulder 74. The upper portion 70 is adapted to be force fit or swagged within the lower end of the smaller tube 60*c* and the lower end of the associated intermediate tube 60*b,* while the lower portion 72 has a diameter slightly smaller that the next larger tube so that it slides relative to the wall of the larger tube. The larger tube of each associated pair is provided with an inwardly rolled edge 76 forming a stop against which the shoulder 74 of the fitting 68 seats preventing the tubes from separating when fully raised. The larger or lower portion 72 is provided with a pair of spaced apart recesses 78 in each of which a ball 80 is held and is also provided with a small horizontal slot 82 on a line with recess 78 when the tubes are fully extended, (i.e., raised) so that the ball 80 can fall and detent within the slot 82, thus acting to lock the tubes in place in the extended position. Passing through the hollow fitting 68 is a piston like element having a conical base 84 integral with a piston rod 86. The piston rod 86 is biased in an upward, (i.e., raised) condition by a compression spring 88 bearing against the end of the upper portion 70 of the fitting and is held by a pin 90. In this normally biased mode, the conical base forces the ball 80 to seat firmly in the slot 82.

The telescoping supports are arranged in pairs to either side of the center line of the housing. In each of these pairs, one support may be denoted as the master and be provided with means by which the telescoping tubes may be releasibly fixed in their upward or extended position. The other support pair of each support pair, need not carry such means, and can, therefore, be denoted as a slave support. As seen in FIG. 4, the master supports denoted by the letter M are arranged diagonal to each other and the slave supports, denoted by the letter S, are similarly diagonal to each other in cruciform to the master cylinders. This arrangement is especially effective when manually releasing the master supports through the use of a ring shaped member as hereinafter described.

These master supports will be provided, as seen in FIG. 5*c*, with an elongated rod 92 which is placed within the smallest tube 60*c,* being held therein by a collar 94 into which a radial pin 96 is seated. The pin 96 extends radially outward through a longitudinal slot 98, which holds the rod 92 in the tube 60*c* while permitting the rod 92 to be longitudinally moveable within the longintudinal slot 98 in collar 94. The pin 96 is fixed in tube 60*c*. The upper end of the rod 92 extends through a removable washer like cap. When the rod 92 is depressed, it acts against piston rod 86 which causes its conical base 88 to also move downwardly against its normal bias to release the balls 80 unlocking the smaller and intermediate tubes. The smaller tube then collapses into the intermediate tube until it also depresses the piston rod of fritting in the intermediate tube. This causes the piston to and its base to simultaneous effect the unlocking of the intermediate tube 60*b* from the largest tube 60*a* to permit the intermediate tube to collapse into the largest tube. It is, of course, appreciated that the collapse of the tubes causes the chimney assembly to be carried downwardly to the inoperative position against the lower platform, the lower platform being still in its upper position.

To manually effect unlocking of the tubes in each of the paired supports, a finger grip ring 104, FIGS. 1–4, is pivotally fastened to one of the slave supports and secured to the rods 92 of the two masters. By simply squeezing the ring 104 downwardly toward its upper platform, FIG. 3, the rods 92 will be depressed and the unlocking action effected.

Depending from the lateral extension 66 is the smoke removal chimney assembly 32. The chimney assembly 32 comprises an upper duct 110 in which is located a slidably movable lower duct extension 112 so that the length of the two ducts can be fully extended. The lower duct extension falls automatically as the smoke removal device is lifted into the operating position and is collapsed as the device is restored into the housing, as the closing of the telescoping supports causing the bottom of the lower duct to engage the lower platform 34. The duct extension 112 and a part of the upper duct 110 have a chordal opening of about one-half of the circumference in which smoke may be blown (see FIG. 1). The bottom 113 of the extension 112 is provided with an ashtray 114. Both the ashtray and the chimney assembly are otherwise fully disclosed in detail in the aforementioned application, application Ser. No. 08/898,298 entitled Apparatus for Removal of Second Hand Smoke, which is incorporated herein as if more fully set forth.

The upper duct 110 is connected to the lateral extension 66 of the upper platform by a swivel joint 116 comprising a ring neck 118 fixedly secured to the open end of the duct 110 for conjoint rotation. Rotatably fit over the neck 118 is a collar 120 which is itself fixedly and staticly attached to the lateral extension 66 by bolts or screws passing through support tabs 119 and 122. The lateral extension 66 is provided with a cut out opening 124 aligned with the neck 118 and collar 120 to allow free flow of air from the duct 110.

The collar 120 is provided with a peripheral slot 126 through which passes the shank of a thumb screw 128 which is removably secured in the neck 118. In this way, the neck and collar are rotatable relatively within the range of the slot 126 and may be easily disconnected one from the other by removal of the set screw 128. The set screw 128 also serves as a handle for manually turning the neck and entire chimney. It will, of course, be appreciated that other forms of swivel joints can be used. The chimney cylinder and duct may be turned right or left in an approximately 180° arc, thereby allowing adjacent players to use the smoke removal device alternately.

An exhaust fan 130 is located above the cut-out opening 124 formed in lateral extension 66 in the manner shown in the aforementioned application. This facilitates the movement of the air through the chimney. It may be desirable to mount a further extension 132 or the like above the fan 130. Such an extension may be advantageously, a tubular member having a curving reduced interior 134 forming a venturi like nozzle acting to propel the smoke to a height selected to be above the breathing level of most people.

Finally, a micro-switch 140 is mounted on the upper surface of the platform adjacent the front panel 18 and a tab 142, functioning as an actuator is mounted on the front panel 18. The switch is connected in a non-conventional manner to an external source of current and via a conduit 144, passing through one of the slave support posts to the fan 130. Thus, when the platform 34 is lifted into its functional or operating position, the fan is automatically started. If desired, the micro-switch 140 can also be connected to a light or other electrical device to show that the smoke remover is operating.

The smoke removal device is normally stowed beneath the table, out of the patrons way and hidden from view. When a smoker/patron seats himself at the table, he grasps the handle and at first pulls the entire housing out from beneath the table until it stops adjacent his seat. There upon, the patron in a non-critical sequence, grasps the upper platform and lifts the entire chimney assembly, extending the telescoping tubular supports and/or continues with manipulation of the handle to lift the platform until the platform reaches the top edge of the housing and engages stops. In either sequence, the chimney assembly is raised to the level of the patron's face where he is able to expel smoke directly into the ducts. Simultaneously, the fan is started and the smoke is removed as seen in FIG. 1, when the patron leaves the apparatus is stowed by the reversing steps first squeezing the release ring.

Various modifications and changes have been disclosed herein, and others will be apparent to those skilled in this art. Therefore, it is to be understood that the present disclosure is by way of illustration and not limiting of the present invention.

What is claimed is:

1. Apparatus for capturing and exhausting primary and secondary smoke generated by a patron seated at a table comprising a box-like container hanging to the undersurface of the table, said container being slidable out from under the table to a position adjacent the patron, a vertically movable bottom platform mounted in said container and a duct like chimney having a elongate chordal opening, said chimney being vertically mounted at one end to said bottom platform, first means for raising and lowering said bottom platform conjointly with said chimney between a first fixed and defined position at the bottom of the container and a second fixed and defined position at the top of container and a second means for raising and lowering said chimney between said second position and a third position above said bottom platform whereby said choral opening is positioned adjacent the patron's face.

2. The apparatus according to claim 1 wherein the said second means for raising and lowering said chimney comprises an array of supporting posts secured to said platform, each of said supporting posts comprising a set of decreasing diameter tubes set one within the other in a slidable telescoping manner and includes a lowermost and largest diameter tube with a lower end and upper end and a smallest diameter tube with an upper end and a lower end, whereby said chimney assembly can be vertically positioned adjacent the user.

3. The apparatus according to claim 2, wherein said first means for raising and lowering said bottom platform comprises a plurality of trackways secured to the interior of said container for recieving said platform and allowing the vertical movement of the same within said trackways and means for counterbalancing said bottom platform and that which is mounted on the platform.

4. The apparatus according to claim 3, wherein said means for counterbalancing said bottom platform comprises a pair of cables secured at one end to the bottom platform and entrained over an upper and lower pulley, the other end of said cables being secured to a spring device.

5. The apparatus according to claim 4, wherein said bottom platform has mounted thereon a quadrilateral array of four elevator supporting posts.

6. The apparatus according to claim 5, wherein said lowermost and largest diameter tube is set within a recess formed in said platform and firmly secured therein.

7. The apparatus according to claim 6, wherein said upper end of said uppermost and smallest diameter tube has mounted thereon an upper platform which is smaller in length and width than said bottom platform.

8. The apparatus according to claim 7, wherein said bottom platform, said top platform and said quadrilateral array of four elevator supporting posts are joined by welding so as to be permanently mounted.

9. The apparatus according to claim 8, wherein said uppermost and smallest diameter tube is connected to said intermediate tube by a hollow fitting and said intermediate tube is connected to said lowermost and largest diameter tube by another said hollow fitting.

10. The apparatus according to claim 9, wherein said hollow fitting comprises a stepped cylindrical member that has an upper portion with an end and a lower portion to offset to provide a shoulder.

11. The apparatus according to claim 10, wherein said upper portion of said stepped cylindrical member is force fitted within said lower end of said uppermost and smallest diameter tube and said upper portion of another said stepped cylindrical member is force fitted within said lower end of said intermediate tube that is associated therewith, wile said lower portion of said stepped cylindrical member has a diameter slightly smaller than a next larger tube so as to allow it to slide relative to said next larger tube.

12. The apparatus according to claim 11, wherein said lowermost and largest diameter tube has an inwardly rolled edge forming a stop against which said shoulder of said stepped cylindrical member seats so as to prevent said set of decreasing diameter tubes from separating when fully raised.

13. The apparatus according to claim 12, wherein said lowermost and largest diameter tube is provided with a pair of space apart recesses, in each of which a ball is held, and a small horizontal slot on a line with said pair of recesses when said set of decreasing diameter tubes are fully raised so as to lock said set of decreasing diameter tubes in place in their extended position when said balls fall and detent within said slot.

14. The apparatus according to claim 13, wherein said hollow fitting has passing therethrough a piston-like element that has a conical base integral with a piston rod.

15. The apparatus according to claim 14, wherein said piston rod of said hollow fitting is normally biased in an upward raised condition by a compression spring that bears against said end of said upper portion of said hollow fitting and is held by a pin so as to cause said conical to force said ball to seat firmly in said slot.

16. The apparatus according to claim 15, wherein said quadrilateral array of four elevator supporting posts are arranged in pairs to either side of said center line of said container, with one post of each pair of posts being master supports that have means for releasable fixing said set of decreasing diameter telescoping tubes in their upward extended position, and with the other post of each pair of posts being slave supports that are free of said means.

17. The apparatus according to claim 16, wherein said master supports are arranged diagonal to each other and said slave supports are generally diagonal to each other.

18. The apparatus according to claim 17, wherein said master supports have an elongated rod with an upper end which is inserted with said uppermost and smallest diameter tube and held therein by a collar into which a radial pin is seated.

19. The apparatus according to claim 18, wherein said radial pin extends radially outward through a threaded hole which holds said elongated rod in said uppermost and smallest diameter tube, while permitting said elongated rod to be longitudinally moveable.

20. The elevator assembly as defined in claim 16, wherein said uppermost and smallest diameter tube of said slave supports has pivotally fastened thereto a finger grip ring that engages said elongated rods of said master supports for manually unlocking said master support in each of said paired supports.

* * * * *